United States Patent [19]

Sasano et al.

[11] Patent Number: 4,990,067

[45] Date of Patent: Feb. 5, 1991

[54] HERMETIC COMPRESSOR

[75] Inventors: Hiroshi Sasano; Hideki Kawai, both of Fujisawa; Toshihiko Ohta, Chigasaki, all of Japan

[73] Assignee: Matsushita Refrigeration Company, Osaka, Japan

[21] Appl. No.: 390,816

[22] Filed: Aug. 7, 1989

[51] Int. Cl.[5] ..... F04B 35/00

[52] U.S. Cl. ..... 417/312; 417/902; 417/DIG. 1

[58] Field of Search ..... 417/312, 540, 541, 542, 417/702, DIG. 1

[56] References Cited

U.S. PATENT DOCUMENTS

| | | | |
|---|---|---|---|
| 4,240,774 | 12/1980 | Ladusaw | 417/902 X |
| 4,313,715 | 2/1982 | Richardson, Jr. | 417/902 X |
| 4,370,104 | 1/1983 | Nelson et al. . | |
| 4,401,418 | 8/1983 | Fritchman | 417/312 |
| 4,411,600 | 10/1983 | Itagaki et al. | 417/312 |
| 4,486,153 | 12/1984 | Romer et al. | 417/312 X |
| 4,531,894 | 7/1985 | Kawai et al. . | |
| 4,549,857 | 10/1985 | Kropiwnicki et al. | 417/902 X |
| 4,573,880 | 3/1986 | Hirano et al. | 417/902 X |
| 4,573,881 | 3/1986 | Romer | 417/902 X |
| 4,582,468 | 4/1986 | Bar | 417/902 X |
| 4,759,693 | 7/1988 | Outzen | 417/312 |
| 4,784,581 | 11/1988 | Fritchman | 417/902 X |
| 4,844,705 | 7/1989 | Gannaway | 417/902 X |
| 4,911,619 | 3/1990 | Todescat et al. | 417/902 X |

FOREIGN PATENT DOCUMENTS

| | | | |
|---|---|---|---|
| 0195486 | 9/1986 | European Pat. Off. | 417/312 |
| 52-008506 | 1/1977 | Japan | 417/312 |
| 2136511 A | 9/1984 | United Kingdom . | |

*Primary Examiner*—Leonard E. Smith
*Assistant Examiner*—Eugene L. Szczecina, Jr.
*Attorney, Agent, or Firm*—Wenderoth, Lind & Ponack

[57] ABSTRACT

A hermetic compressor according to the present invention has an improved operating efficiency for use in a cold storage chamber, freezing chamber or the like . The compression includes a suction pipe which is formed by a material having heat conductivity lower than that of a casing of the hermetic compressor so that heat of the closed casing is not easily transmitted to the suction pipe. In this manner heating of the drawn in cooling medium gas is inhibited, and thus, cooling efficiency can be improved by preventing discharge of a low density cooling medium into the cooling system through compression of the expanded cooling medium gas.

7 Claims, 5 Drawing Sheets

HERMETIC COMPRESSOR

BACKGROUND OF THE INVENTION

The present invention generally relates to a compressor and more particularly, to a hermetic compressor for use in a cold storage chamber, freezing chamber or the like.

It has been a recent trend that an improvement in the compression efficiency has been required for a reciprocating type cooling medium compressor to be employed in a cooling system such as a cold storage chamber, freezing chamber or the like.

As one technique for meeting such a requirement, there has been conventionally proposed a construction in which the disadvantage that a suction gas is heated and expanded in the compressor so that the suction gas with a low density is drawn into a cylinder and eliminated, whereby reduction in density of the suction gas is prevented so as to provide higher suction efficiency.

By way of example, one known arrangement is disclosed in U.S. Pat. No. 4,370,104 in which, by mounting a suction pipe on a casing, a suction muffler having its inlet portion facing an outlet of said suction pipe, and formed into a horn shape is provided within the casing, so that said suction muffler is connected to a suction plenum. Another example disclosed, for example, in U.S. Pat. No. 4,531,894, is so arranged that, with a suction pipe being led up to a suction muffler, an outlet portion of said suction muffler is mounted on a cylinder head.

In the above conventional arrangements, however, since suction pipes generally made of copper are employed, such suction pipes are heated through heat exchange with respect to the casing of the compressor, with consequent heating of the suction gas. Therefore, arrangement is so made that the heated suction gas is not easily returned by returning most of or all of the suction gas into the suction muffler. However, when the fact that the suction gas is heated by the suction pipe, is taken into account, sufficient improvement of the compression efficiency has not been available.

SUMMARY OF THE INVENTION

Accordingly, an essential object of the present invention is to provide an improved hermetic compressor which is so arranged that, in order to prevent suction gas of the cooling medium compressor from being heated by a casing, a suction pipe is formed by a material having a low heat conductivity as compared with that of the casing, while an outlet port of the suction pipe is positioned within a suction muffler or in the vicinity of an inlet portion of said suction muffler so as to facilitate entry of the suction gas into the suction muffler.

Another object of the present invention is to provide a hermetic compressor of the above-described type which is simple in construction and functions at in a highly reliably manner.

In accomplishing these and other objects, according to one preferred embodiment of the present invention, there is provided a hermetic compressor which includes a closed casing, a compressing unit provided with a cylinder block having a cylinder formed with an opening and accommodated in said closed casing and a piston accommodated in said cylinder, an electric motor for reciprocating the piston of said compressing unit, a valve plate provided to cover the opening of said cylinder and provided with valves at a suction port and a discharge port thereof, a header provided for the valve seat at its side remote from said cylinder, a suction muffler for leading a cooling medium to the suction port of said valve plate a discharge muffler into which the cooling medium from the discharge port of said valve plate flows so as to be led to outside of said closed casing, and a suction pipe fixed to said closed casing for leading the suction gas to said suction muffler, with said suction pipe being formed by a material having a low heat conductivity as compared with that of the closed casing.

By the above arrangement, a hermetic compressor superior in compression efficiency has been provided, with a substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
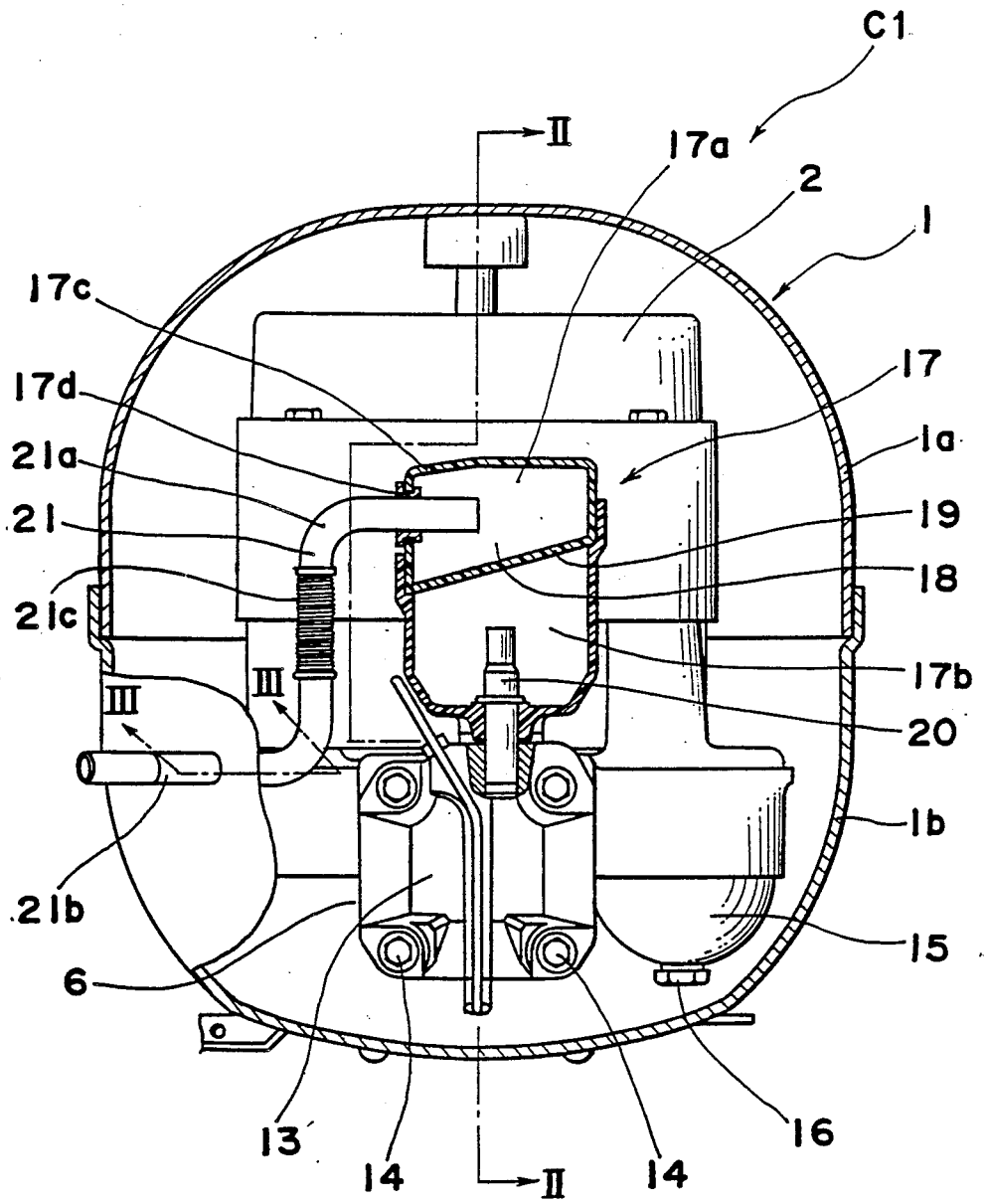
FIG. 1 is a side sectional view of a hermetic compressor according to one preferred embodiment of the present invention.

Before the description of the present invention proceeds, it is to be noted that like parts are designated by like reference numerals throughout the accompanying drawings.

Figure 2:
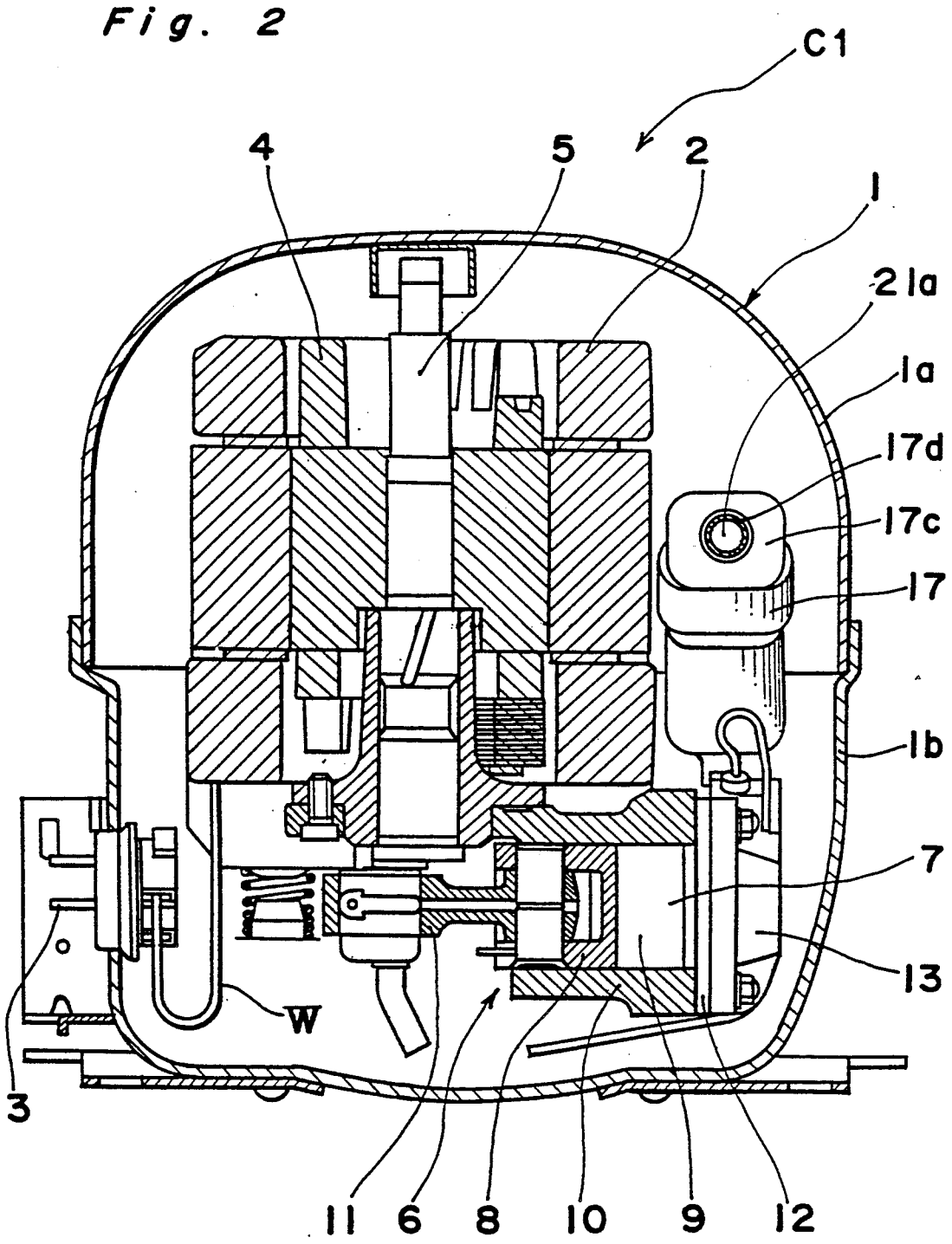
FIG. 2 is a cross section taken along the line II—II in FIG. 1.
Figure 3:
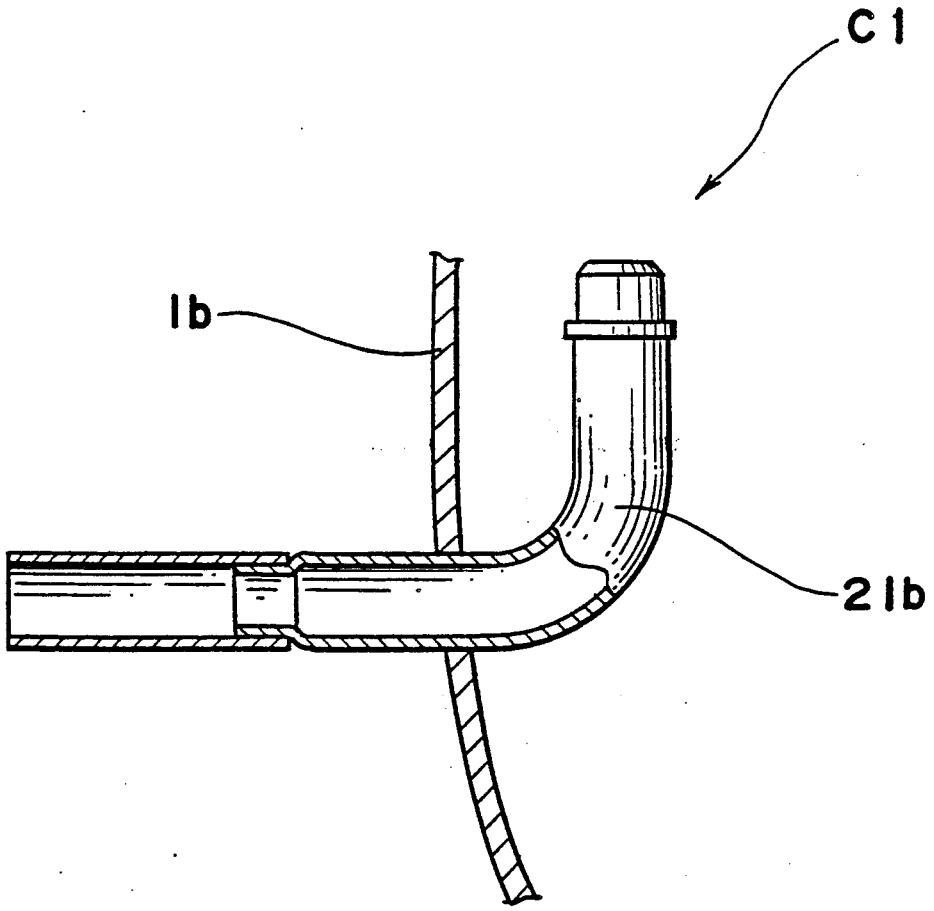
FIG. 3 is also a fragmentary cross section taken along the line III—III in FIG. 1.

Referring now to the drawings, there is shown in FIGS. 1 to 3, a hermetic compressor C1 according to one preferred embodiment of the present invention, which generally includes a closed casing 1, a compressing unit 6 provided with a cylinder block 10 having a cylinder 9 formed with an opening 7 and accommodated in the closed casing 1 and a piston 8 accommodated in the cylinder 9, an electric motor 2 for reciprocating the piston 8 of the compressing unit 6, a valve plate 12 provided to cover the opening 7 of the cylinder 9 and provided with valves at a suction port and a discharge port thereof, a header provided for the valve plate 12 at its side remote from the cylinder 9, a suction muffler 17 for leading a cooling medium to the suction port of the valve plate 12, a discharge muffler 15 into which the cooling medium from the discharge port of the valve plate 12 flows so as to be led to outside of the closed casing 1, and a suction pipe 21 fixed to the closed casing 1 for leading the suction gas to the suction muffler 17.

More specifically, the closed casing 1 made, for example, of iron is constituted by an upper casing 1*a* fitted over a peripheral edge of a lower casing 1*b*, with a junction therebetween being welded. On the upper side of the casing 1, there is provided the electric motor 2 connected through wires W, with an electric plug 3 provided in the lower casing 1*b* at the left side in FIG. 2, with a crank shaft 5 which extends vertically in FIG. 2 and is mounted on a rotor 4 of said motor 2.

The compressing unit 6 located at the lower side of the closed casing 1 includes the cylinder block 10 provided with the cylinder 9 having the opening 7 at its one side, and the piston 8 movably accommodated therein. Said piston 8 is connected with said crank shaft 5 through a connecting rod 11 so as to transmit rotation of the crank shaft 5 to the piston 8 following the reciprocating movement thereof. At the opening 7 of the cylinder 9, the valve plate 12 having the suction port, discharge port, and valves provided at both ports (not particularly shown), and a cylinder head 13 are attached. As shown in FIGS. 1 and 2, this cylinder head 13 is fixed to the cylinder block 10 through the valve plate 12 by set screws 14.

The discharge muffler 15 which receives the flow of the compressed cooling medium gas discharged from said discharge port, and then, leads said gas out of the closed casing 1, is fixed to the cylinder block 10 by a screw 16. The suction muffler 17 arranged to guide the cooling medium into said suction port is made, for example, of a plastic material, and is divided into an upper chamber 17*a* and a lower chamber, 17*b* through a plate 19 having a hole 18 formed therethrough. The lower chamber 17*b* is arranged to lead the cooling medium to said suction port through a communicating pipe 20, while the upper chamber 17*a* has a hole 17*d* formed in its side wall 17*c*. The suction pipe 21 extending from the exterior of the closed casing 1 to the suction muffler 17 inside said casing 1 is folded in generally an L-shape, and includes a first passage 21*a* having its one end inserted through the hole 17*d*, into the upper chamber 17*a* of the suction muffler 17 so as to be positioned therein, a second passage (21*b* fixed to the lower casing lb of the closed casing 1 and also folded generally in an L-shape so as to be positioned, at its one end, outside the closed casing 1, and a third passage 21*c* formed by closely winding a wire material in a coil shape for connecting said first passage 21*a* with said second passage 21*b*. In the suction pipe 21 having the construction as described above, at least the second passage 21*b* is formed by stainless steel having a heat conductivity lower than that of iron which is the material for the closed casing 1. It is to be noted here that the first passage 21*a* and the third passage 21*c* may be formed either of copper or stainless steel.

In the above arrangement, the cooling medium gas returned from the suction pipe 21 proceeds through the suction muffler 17 and is compressed by the piston 8 in the cylinder 9 so as to be further discharged outside via the discharge muffler 15.

In the above case, the process in which reduction in density of the suction gas is prevented through compression of the heated cooling medium gas in the closed casing 1 by directly returning the cooling medium gas into the suction muffler 17, is generally similar to the process as disclosed in U.S. Pat. No. 4,370,104 referred to earlier. However, it should be particularly noted here that according to the hermetic compressor C1 of the present invention as described so far, owing to the construction that the second passage 21*b* of the suction pipe 21 contacting the closed casing 1 is made of stainless steel, the heat of the closed casing 1 is not readily conducted to said second passage 21*b*, and thus, the cooling medium gas is free from expansion by heating at this second passage 21*b*, whereby density lowering of the drawn-in cooling medium gas may be advantageously prevented.

Figure 4:
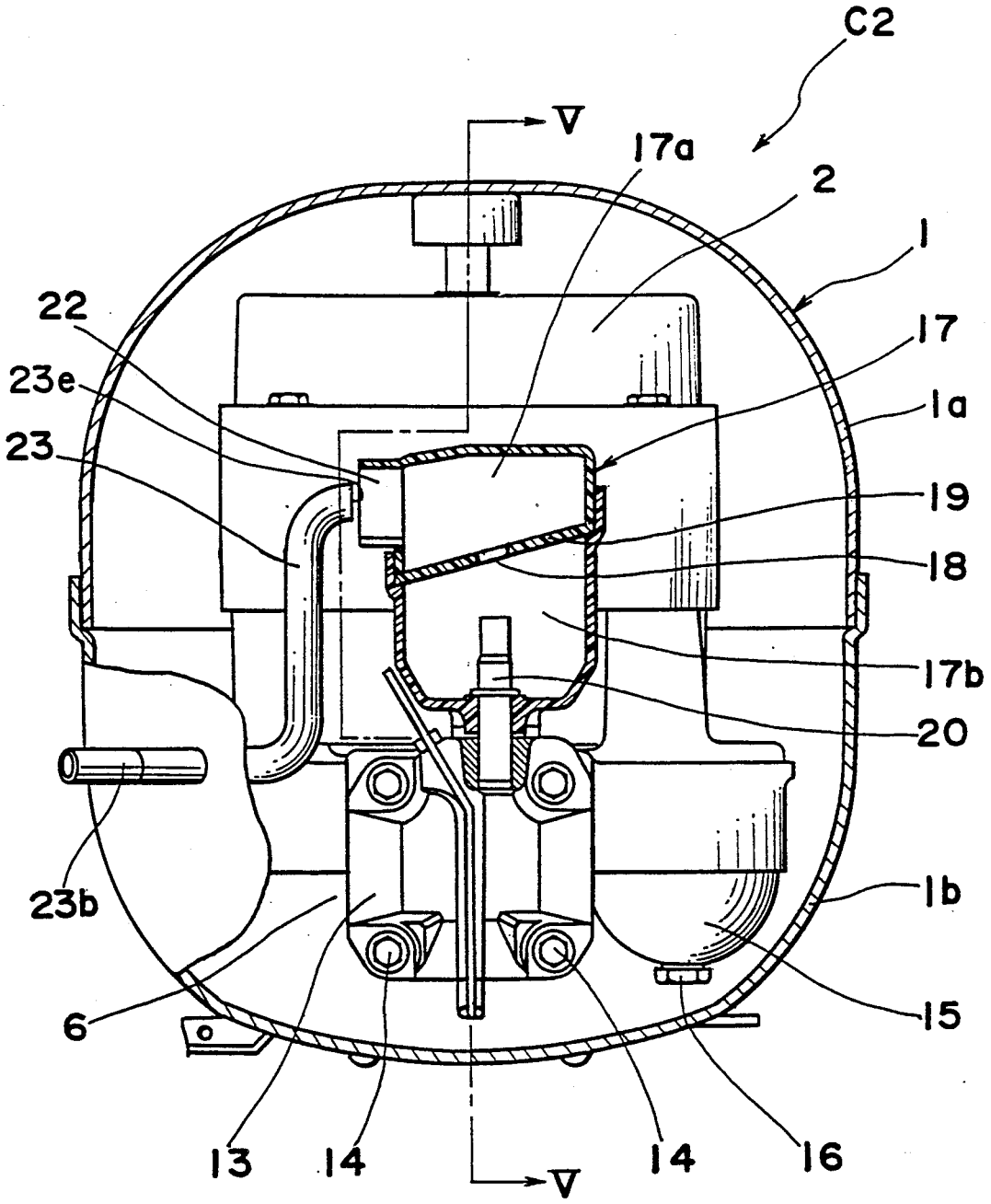
FIG. 4 is a side sectional view similar to FIG. 1, which particularly shows another embodiment of the present invention.
Figure 5:
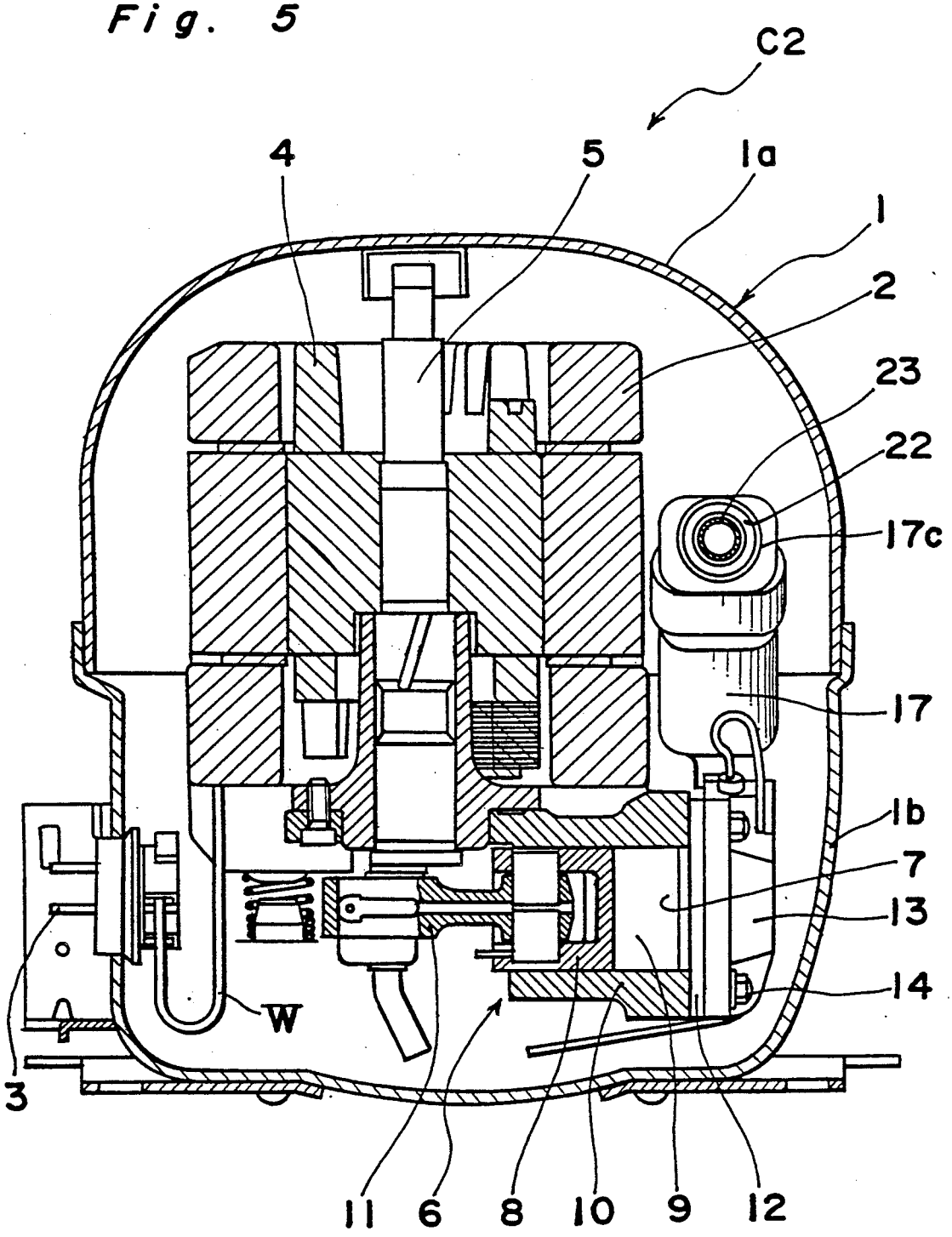
FIG. 5 is a cross section taken along the line V—V in FIG. 4.

Referring further to FIGS. 4 and 5, there is shown a modification of the hermetic compressor C1 described so far with reference to FIGS. 1 to 3, with like parts in FIGS. 1 to 3 being designated by like reference numerals for brevity of description.

In the modified hermetic compressor C2 in FIGS. 4 and 5, the hole 17*d* described as formed in the side wall 17*c* of the suction muffler 17 in the hermetic compressor C1 in FIGS. 1 to 3 is replaced by another hole 22 which is formed to have a diameter larger than that of a suction pipe 23. One end of said suction pipe 23 has its open end portion 23*e* positioned close to said hole 22 as illustrated, with said suction pipe 23 being made of stainless steel having heat conductivity lower than that of the closed casing 1. In this case also, since most of the cooling medium gas sucked in through the suction pipe 23 is introduced into the suction muffler 17, there is no possibility that the expanded cooling medium gas is compressed for lowering in density. Moreover, since the second passage 23*b* of the suction pipe 23 is lower in the heat conductivity than the closed casing 1, heat from the closed casing 1 is not readily conducted, and heating of the sucked in cooling medium is inhibited. Therefore, undesirable compression of the expanded cooling medium gas is eliminated, whereby reduction of cooling performance by the density lowering of the cooling medium gas can be advantageously prevented.

Although the present invention has been fully described by way of example with reference to the accompanying drawings, it is to be noted here that various changes and modification will be apparent to those skilled in the art. Therefore, unless such changes and modifications otherwise depart from the scope of the present invention, they should be construed as included therein.

What is claimed is:

1. A hermetic compressor which comprises a closed casing, a compressing unit provided with a cylinder block having a cylinder formed with an opening and accommodated in said closed casing and a piston accommodated in said cylinder, an electric motor for reciprocating the piston of said compressing unit, a valve plate provided to cover the opening of said cylinder and provided with valves at a suction port and a discharge port thereof, a header provided for the valve seat at its side remote from said cylinder, a suction muffler mounted in said closed casing for leading a cooling medium to the suction port of said valve plate, a discharge muffler into which the cooling medium from the discharge port of said valve plate flows so as to be led to outside of said closed casing, and a suction pipe fixed to and extending outside of said closed casing for leading the suction gas from outside of said closed casing to said suction muffler, said suction pipe being formed of a material having a low heat conductivity as compared with that of said closed casing.

2. A hermetic compressor as claimed in claim 1, wherein said closed casing is formed of iron and said suction pipe is formed of stainless steel.

3. A hermetic compressor which comprises a closed casing, a compressing unit provided with a cylinder block having a cylinder formed with an opening and accommodated in said closed casing and a piston accommodated in said cylinder, an electric motor for reciprocating the piston of said compressing unit, a suction muffler mounted in said closed casing in communication with a suction port of said compressing unit, and a suction pipe fixed to said closed casing and having one end thereof inserted in said suction muffler and the other end thereof extending outside of said closed casing, said suction pipe being formed of a material having a low heat conductivity as compared with that of said closed casing.

4. A hermetic compressor as claimed in claim 3, wherein said suction pipe includes a first passage with one end inserted in said suction muffler, a second passage fixed to said closed casing and formed of said material having a heat conductivity lower than that of said closed casing, and a flexible third passage connecting said first passage with said second passage.

5. A hermetic compressor as claimed in claim 4, wherein said third passage is formed by a coil spring.

6. A hermetic compressor which comprises a closed casing, a compressing unit provided with a cylinder block having a cylinder formed with an opening and accommodated in said closed casing and a piston accommodated in said cylinder, an electric motor for reciprocating the piston of said compressing unit, a suction muffler in communication with a suction port of said compressing unit, and a suction pipe having one end opening in the vicinity of an inlet of said suction muffler, and the other end extending outside of said closed casing, said suction pipe being formed of a material having a low heat conductivity as compared with that of said closed casing.

7. A hermetic compressor as claimed in claim 6, wherein said suction pipe is made of stainless steel.

* * * * *

UNITED STATES PATENT OFFICE

CERTIFICATE OF CORRECTION

Patent No. 4,900,067 Dated 02/13/90

Inventor(s) JANSEN, ET AL

It is certified that error appears in the above-identified patent and that said Letters Patent is hereby corrected as shown below:

At Column 1, Line 31, "a" should be deleted;

At Column 1, Line 31, "packoff" should be--packoffs--;

At column 2, Line 15, a semicolon should follow "annulus";

At column 2, line 46, a comma should follow the word "sidewards";

At column 8, line 60, "an" should be--and--;

At column 8, line 65, "with" should be--which--.

Signed and Sealed this

Twenty-eighth Day of April, 1992

*Attest:*

HARRY F. MANBECK, JR.

*Attesting Officer*

*Commissioner of Patents and Trademarks*